United States Patent [19]

Morley

[11] 4,148,109

[45] Apr. 10, 1979

[54] TRACK CHAIN BUSHING FACE CLEANER

[75] Inventor: Roy D. Morley, Peoria, Ill.

[73] Assignee: Caterpillar Tractor Co., Peoria, Ill.

[21] Appl. No.: 773,044

[22] Filed: Feb. 28, 1977

[51] Int. Cl.[2] ..... A47L 5/14

[52] U.S. Cl. ..... 15/345; 29/525; 59/11

[58] Field of Search ..... 15/345, 346; 59/7, 11; 29/525

[56] References Cited

U.S. PATENT DOCUMENTS

| | | | |
|---|---|---|---|
| 3,097,477 | 7/1963 | Rodgers | 59/7 |
| 3,222,707 | 12/1965 | Allenbaugh | 15/345 |
| 3,510,905 | 5/1970 | Bannert | 15/345 |
| 3,972,089 | 8/1976 | Parks | 15/345 |
| 3,978,547 | 9/1976 | Lawson | 15/345 |

*Primary Examiner*—Christopher K. Moore

*Attorney, Agent, or Firm*—Wegner, Stellman, McCord, Wiles & Wood

[57] ABSTRACT

A tool for cleaning slivers and the like from a surface of a workpiece, such as the bushing of a chain drive track. In one form, the tool includes structure defining a manifold having an opening and arranged to be abutted to the workpiece with the opening juxtaposed to the workpiece surface on which slivers and the like may be deposited. Fluid, such as air, under pessure is delivered into the manifold and directed substantially directly against the juxtaposed workpiece surface to entrain the slivers and other foreign matter on the prelubricated surfaces. A suction is applied to the manifold for sucking the excess fluid and the entrained slivers and other material outwardly from the manifold. In another form, the manifold is movable against complementary wall surfaces to define a chamber in which the workpiece is disposed. Movement of the manifold to and from the wall surface may be effected by suitable powered mechanism. In each form, the tool is particularly adapted for removing chips and slivers from workpieces wherein one element has been joined as by pressing to another. Preferably, the suction applied to the manifold is greater than the force of the pressurized fluid so as to assure removal of the slivers and other foreign material dislodged from the workpiece surface by the high pressure air.

8 Claims, 4 Drawing Figures

TRACK CHAIN BUSHING FACE CLEANER

BACKGROUND OF THE INVENTION

1. Field of the Invention

This invention relates to cleaning tools and in particular to tools for cleaning a workpiece surface of foreign particulate material.

2. Description of the Prior Art

In manufacturing processes, it is conventional to utilize high pressure fluid, such as high pressure air, to clean workpiece surfaces by blasting foreign particulate material and the like from the surface. Conventionally, high pressure air is delivered through suitable hoses to a valve nozzle which may be manipulated by the user to direct a blast of high pressure air against the workpiece surface, thereby blowing chips, slivers, and other similar particular material from the workpiece surface for subsequent further processing of the workpiece. One such workpiece surface comprises the face of the tack chain bushings. In making such chains for use in driving tractors and the like, chips and slivers are often left on the bushing face during the chain assembly operations which especially adhere to prelubricated surfaces.

In such manufacturing operations, the foreign material may be adhered to the workpiece surface by oil or grease and, thus, it is further conventional to utilize rags, cotton gloves, and brushes to thoroughly clean the surface. In such an application, it is important to provide an effectively clean surface as the bushing face subsequently is abutted to the seal and such chips and slivers may chew up the seal during subsequest use of the track with the subsequent loss of lubricant and thereby causing expensive and time-consuming maintenance.

One attempted solution to the problem has been to prevent the formation of chips and slivers in the assembling of the track chain. This solution has not proven entirely satisfactory. On the other hand, the use of manually applied disengaging and cleaning means, including the manually directed nozzle air jets, has not proven completely satisfactory because of variations in the manual operations resulting in nonconsistent, defective cleaning of the surfaces. Further, the conventional cleaning of the surfaces is relatively time-consuming, adding a significant cost to the manufacturing operations.

SUMMARY OF THE INVENTION

The present invention comprehends an improved tool for cleaning such foreign particulate material from a work surface which utilizes a combination of high pressure fluid jets for dislodging the material and suction means for removing the dislodged material entrained in the fluid to a discharge position.

More specifically, the present invention comprehends in one embodiment such an improved cleaning tool which includes wall means defining a manifold having an opening and arranged to be abutted to the workpiece with the opening juxtaposed to the workpiece surface, fluid supply means for delivering fluid under a high pressure through the manifold substantially directly against the juxtaposed workpiece surface to dislodge the foreign particulate material from the surface, and suction means for sucking the fluid and dislodged foreign particulate material entrained in the fluid outwardly from the manifold.

The surface cleaning tool may include a second manifold within the first manifold having a plurality of jet ports which are directed toward the opening of the first manifold so as to impinge the fluid directly against the workpiece surface to be cleaned.

The ports may be circumferentially spaced in the second manifold where the workpiece surface comprises an annular surface, such as the bushing face surrounding the track pin in a track assembly.

The high pressure fluid may be delivered to the inner manifold by means of a suitable duct, such as a high pressure air hose, and the fluid with the entrained foreign material may be removed from the manifold by a suitable duct, such as a suction tube.

In the illustrated embodiment, the capacity of the suction means is substantially greater than that of the high pressure fluid means so as to effectively withdraw the fluid delivered against the workpiece surface together with the entrained foreign material from the manifold.

Further in the illustrated embodiment, the suction means opens to the manifold in a direction substantially transversely to the direction of the high pressure jets so as to effect an optimum entrainment of the foreign material dislodges from the workpiece surface for improved cleaning operation.

In another form, the manifold may be operated toward and from a table and press tooling portions to enclose the workpiece surface by suitable power means so as to provide an automatic cleaning of the workpiece track upon completion of the pressing together thereof, eliminating the need for manual cleaning operations.

Thus, the workpiece cleaning tool of the present invention in each of its illustrated forms is extremely simple and economical of construction while yet providing the highly desirable features discussed above.

BRIEF DESCRIPTION OF THE DRAWING

Other features and advantages of the invention will be apparent from the following description taken in connection with the accompanying drawing wherein.

DESCRIPTION OF THE PREFERRED EMBODIMENTS

Figure 2:
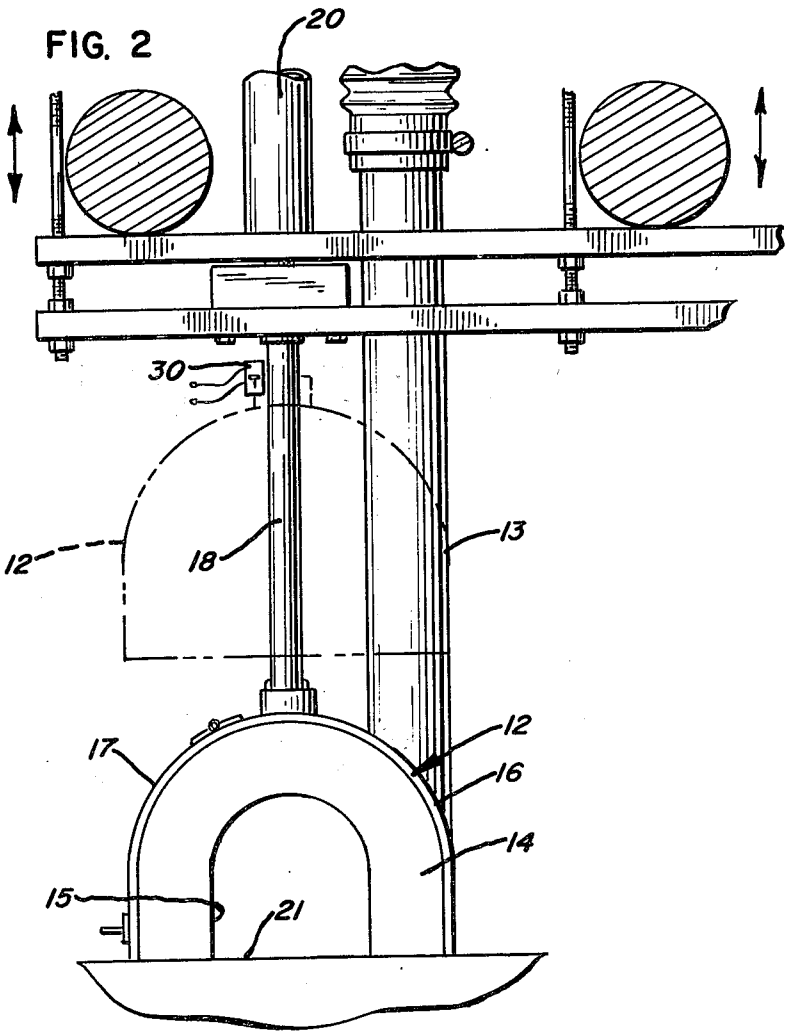
FIG. 2 is a side elevation thereof with the press tooling omitted.
Figure 1:
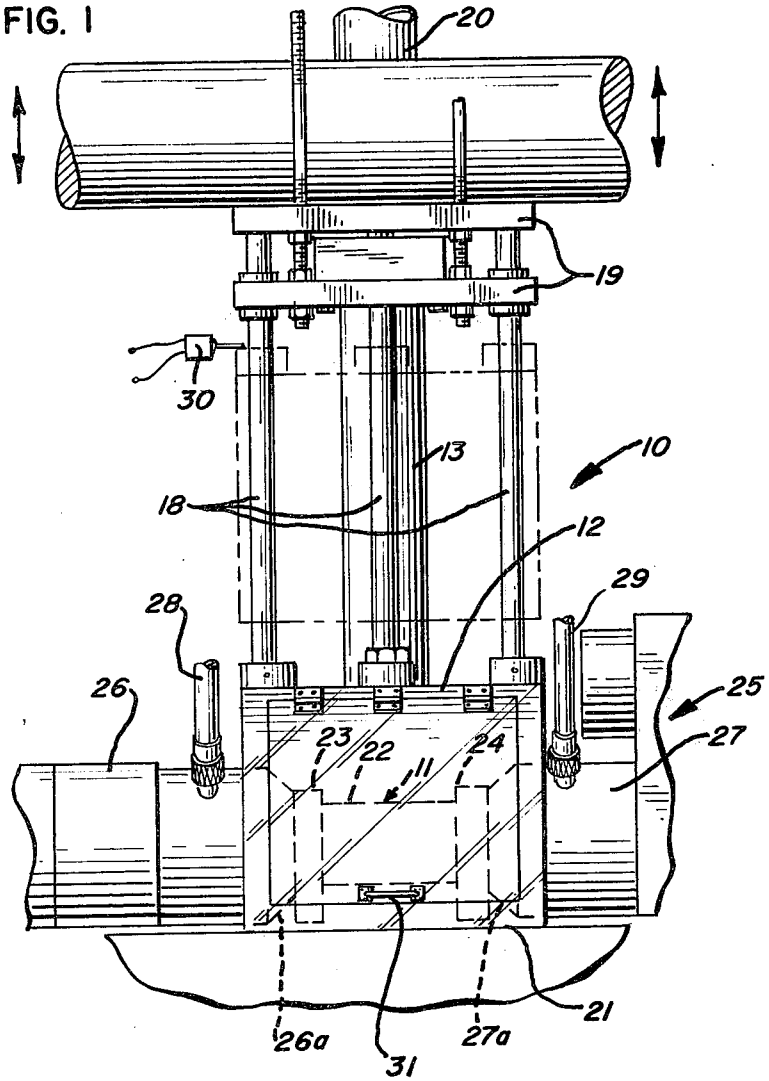
FIG. 1 is a front elevation of a cleaning tool embodying the invention with portions broken away to facilitate illustration thereof with the workpiece and press tooling in position for a cleaning operation.

In the exemplary embodiment of the invention as disclosed in FIGS. 1 and 2 of the drawing, a tool generally designated 10 for cleaning a workpiece generally designated 11 is shown to comprise a manifold portion 12 12 to which is connected a suction line, or vacuum tube, 13.

The manifold portion 12 is generally U-shaped in cross section, as shown in FIG. 2, having U-shaped end walls 14 provided with central U-shaped openings 15. The front face of the sidewall 16 is provided with a hinged, transparent door 17 permitting the operator to view the interior of the manifold portion 12 during a cleaning operation.

The manifold portion 12 is supported on a plurality of rods 18 secured to suitable mounting plates 19 adapted to be moved vertically, as shown in FIG. 1, by a suitable 12" stroke air cylinder 20 to bring the manifold toward and from the workpiece 11 which is supported on a conventional table 21 during a cleaning operation.

Figures 3, 4:
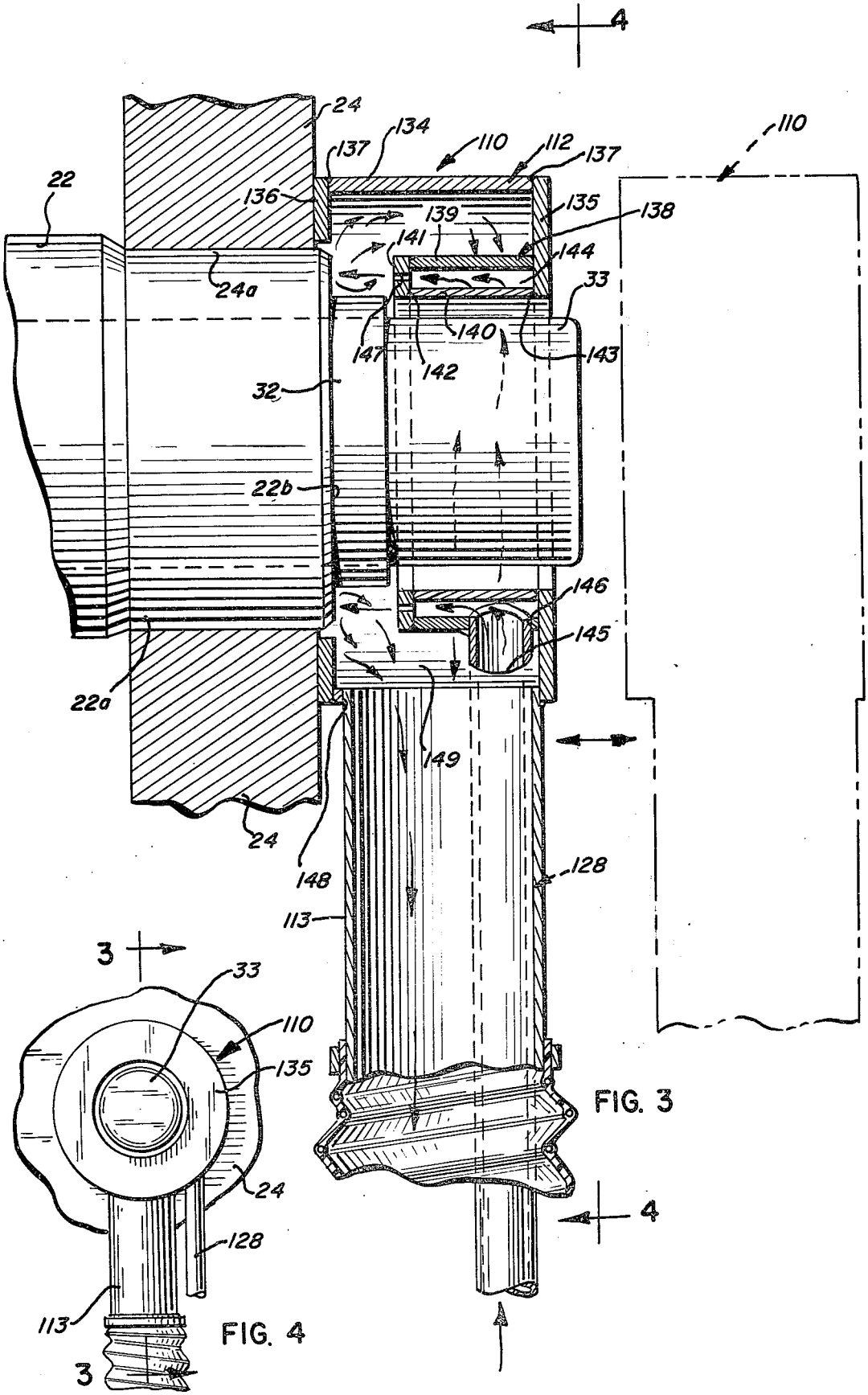
FIG. 3 is a vertical section taken substantially along line 3—3 of FIG. 4 of a modified form of cleaning tool embodying the invention.
FIG. 4 is a front elevation thereof.

In the illustrated embodiment, the workpiece 11 comprises an assembly of a track chain structure which includes a central bushing 22 onto the opposite ends of which is pressed a pair of opposed track links 23 and 24 (see FIG. 3).

Links 23 and 24 are pressed onto the opposite ends of bushing 22 by suitable press tooling generally designated 25 defining a lefthand manifold wall portion 26 and a righthand manifold wall portion 27. As shown in FIGS. 1 and 2, the U-shaped opening 15 in each of the end walls 14 of the manifold portion 12 is adapted to fit around the tooling portions 26 and 27 at the opposite sides of the manifold portion 12 so that the table 21, manifold portion 12, and tooling portions 26 and 27 cooperatively effectively comprise means to define a closed manifold chamber in which the workpiece 11 is disposed during the cleaning operation. In the illustrated embodiment, the track links 23 and 24 are pressed onto the bushing also when within the chamber so that both an assembly and cleaning operation may be effected. Upon completion of the assembly and cleaning operation, the assembled and cleaned track portion is indexed from the position of FIG. 1 with the manifold first being raised by the cylinder 20 to a position above the press tooling, thereby permitting the next set of components 22, 23, and 24 to be positioned between the press tooling portions 26 and 27 for a subsequent assembling and cleaning operation as described above.

The cleaning of the opposite ends of the bushings within the manifold chamber is effected by the delivery of high pressure fluid thereto while concurrently effecting a greater suction force. The high pressure fluid may comprise high pressure air delivered to the press tooling portions 26 and 27 by supply means such as air ducts, or hoses, 28 and 29, respectively. The high pressure air is discharged from the tooling portions 26 and 27, respectively, inwardly toward the opposite ends of the bushing 22 exposed at the outer face of each of the track links 23 and 24, said air being delivered from within frustoconical inner end portions **26*a* and 27*a* of the tooling 26 and 27, respectively. The arrangement of the pressed-on track link 24 and bushing end 22*a* in the assembled relationship with respect to the desired cleaning air flow may be best seen in FIG. 3**.

As further illustrated in FIGS. 1 and 2, the automatic movement of the manifold portion 12 to and from the work-enclosing disposition may be controlled by suitable limit switch means, such as limit switch means 30.

The transparent door 17 may be provided with a suitable handle 31 to provide access to the interior of the manifold portion 12 when desired.

Referring now to FIGS. 3 and 4, a more specific illustration of the cleaning action provided by the present invention is illustrated in connection with a hand-held form of cleaning tool generally designated 110 which is similar to tool 10 in providing a blast of high pressure air against the workpiece while concurrently withdrawing the air together with any foreign material entrained therein removed from the workpiece surfaces, by means of a relatively large suction force.

Thus, as best seen in FIG. 3, the bushing end **22*a* is caused to project through an opening 24*a* in the track link 24 so as to expose an end surface 22*b* of the bushing outwardly of the track link. A conventional thrust ring 32 is mounted on the axial track pin 33** extending through the bushing, the track pin, thrust ring, and bushing being preassembled prior to the assembly of the track links therewith at the opposite ends of the bushing.

The pressing of the track links onto the bushing ends has been found to cause slivers and other particulate foreign matter to be produced and deposited on the end surface **22*b*** of the bushing at times. Such deposition is undesirable in that such matter tends to chew up the seal which is subsequently applied to the track assembly, permitting loss of lubricant and thereby shortening the useful life of the chain.

In the hand-held version 110, the manifold 112 comprises an annular manifold having a cylindrical outer wall 134, a first planar, annular end wall 135, and a second planar, annular end wall 136. The end walls may be secured to the cylindrical wall 134 as by welding 137.

As shown in FIG. 3, the inner diameter of end wall 136 is larger than the inner diameter of end wall 135, and is more specifically adapted to encircle the projecting end **22*a* of the bushing defining the end surface 22*b*** to be cleaned.

Tool 110 further defines an inner manifold generally designated 138 comprising a cylindrical outer wall 139, a cylindrical inner wall 140, and an annular inner end wall 141. End wall 141 is secured to the inner ends of the walls 139 and 140 as by welding 142 and the assembly of the walls 139, 140 and 141 is secured to the inner surface of the end wall 135 as by welding 143.

High pressure air is delivered to the chamber 144 defined by the manifold 138 through a high pressure supply line, or duct, 118 which passes through an opening 145 in the outer manifold wall 134 and an opening 146 in the inner manifold outer wall 139.

Air is delivered from chamber 144 through a plurality of jet ports 147 in an annular array in inner end wall 141 of manifold 138. The ports, in the illustrated embodiment, open parallel to the axis of the manifolds so as to direct the high pressure air in a plurality of forcible jets against the bushing surface **22*b*** thereby to dislodge slivers, chips, and other foreign material adhering to the bushing surface. It has been found that such high pressure jets efficiently and fully clean such material from such surfaces notwithstanding the presence of an oil film as may be found conventionally on the track element surfaces during the assembly operation.

As further shown in FIGS. 3 and 4, the suction line, or duct, 113 extends through an opening 148 in the outer manifold wall 134 for drawing the air with the entrained foreign matter therein radially outwardly from the outer manifold chamber 149. As indicated above, the suction force is preferably greater than the high pressure air supply force so that while the air jets from ports 147 serve to dislodge the foreign material dynamically, the manifold chamber 149 is effectively under a suction pressure so that all of the jet air, as well as any air which may leak from the ambient atmosphere into the chamber 149, as around the track pin 33, will be forcibly sucked away from the bushing surface **22*b* to effectively clean the surface of all foreign material. In the embodiment of FIGS. 1 and 2, tool 10 permits some ambient atmosphere to enter the manifold 12 adjacent the table 21, as best seen in FIG. 2, to provide the improved suction action therein, as discussed relative to tool 110** above.

In the illustrated embodiment of tool 10, the suction tube 13 may have a diameter of approximately 3" with the high pressure supply line 18 having a diameter of approximately ½". The retraction stroke of the manifold may be approximately 12" so as to provide free clearance to the work table for facilitating subsequent assembly operations thereon. In the hand-held tool 110, the suction line has a diameter of approximately 1⅝" with the high pressure line having a diameter of approximately ½". In each of the embodiments, the air pressure was 90 lbs. per square inch.

Suitable fluid controls may be provided for applying the high pressure air and suction only during the cleaning operation, i.e., when the tool is installed in the cleaning disposition illustrated in full lines in the drawing.

In addition to the effectively positive cleaning of the workpieces, the present invention provides improved safety in the assembling operation by avoiding the possibility of metal slivers and the like being thrown into the operator's eyes or against his person. The positive suction action provided by the greater suction force effectively assures the entrainment of substantially all foreign material from the surfaces being cleaned into the air stream flowing through the manifold chamber to the suction line, and more positively, effects a suction of some of the ambient atmosphere into the stream to not only provide improved mixing action and thereby entrainment of the foreign material in the air flow stream, but also improved safety in the assembling operation, as discussed above.

The foregoing disclosure of specific embodiments is illustrative of the broad inventive concepts comprehended by the invention.

The embodiments of the invention in which an exclusive property or privilige is claimed are defined as follows:

1. Apparatus for cleaning foreign particulate material from a surface of a workpiece having a first portion pressed onto a second portion, comprising:

movable press tooling for pressing said workpiece first portion onto said second portion;

mans including a portion of the press tooling for defining an effectively closed chamber arranged to have the workpiece surface exposed therein;

fluid supply means movable with said press tooling for delivering fluid under high pressure into said manifold chamber and substantially directly against said exposed workpiece surface within said manifold chamber to dislodge foreign particulate material from said surface; and suction means for sucking the fluid and dislodged foreign particulate material entrained in the fluid outwardly from the manifold chamber.

2. The surface cleaning tool of claim 1 wherein said suction means opens to said manifold chamber in a direction transverse to the direction of flow of said fluid against said surface by said supply means.

3. The surface cleaning tool of claim 1 wherein said fluid supply means comprises a pair of supply means opening into said manifold chamber.

4. The surface cleaning apparatus of claim 1 further including power means for moving a portion of said manifold chamber means selectively toward and from said press tooling to form said manifold chamber in which said workpiece surface is disposed.

5. The surface cleaning tool of claim 1 wherein said manifold chamber means is provided with an access opening and closure means for selectively closing said access opening.

6. The surface cleaning apparatus of claim 1 wherein said fluid supply means is arranged to deliver the high pressure fluid to the press tooling for discharge of the fluid from the tooling toward the workpiece.

7. The surface cleaning apparatus of claim 1 wherein said press tooling has a frustoconical inner end portion engageable with said workpiece surface and said fluid supply means is arranged to deliver the high pressure fluid to the press tooling for discharge of the fluid against the workpiece adjacent said tooling frustoconical portion.

8. In an apparatus for press fitting a pair of chain links onto opposite ends of a chain bushing including a pair of press tooling portions one each at said opposite ends movably toward said ends to press the respective links onto said ends and a wall subjacent the press tooling and said links and bushing, the improvement comprising:

means for delivering high pressure air from an outer portion of each of said press tooling portions to an inner portion thereof to discharge against said links and bushing ends;

a movably mounted wall member having edge portions engageable with said press tooling portions and said wall to define a substantially closed manifold chamber in which the track links and bushings are disposed, said edge portions engaging said tooling portions being complementary thereto to permit movement of the press tooling portions toward said bushing ends to effect the pressing of the links onto the bushng ends in the closed manifold chamber and subsequent cleaning of the assembled links and bushings by the pressurized air within the closed manifold chamber; and means movable with the movably mounted wall for applying a suction to said closed manifold chamber greater than the air pressure force to effectively positively withdraw the air and material entrained therein by the cleaning of the assembled links and bushings.

* * * * *